US010424454B2

(12) United States Patent
Seo

(10) Patent No.: US 10,424,454 B2
(45) Date of Patent: Sep. 24, 2019

(54) MULTI-POLE MOLDED CASE CIRCUIT BREAKER WITH A SAFETY DEVICE

(71) Applicant: LSIS CO., LTD., Anyang-si, Gyeonggi-do (KR)

(72) Inventor: Jaekwan Seo, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 440 days.

(21) Appl. No.: 15/368,519

(22) Filed: Dec. 2, 2016

(65) Prior Publication Data

US 2017/0186579 A1 Jun. 29, 2017

(30) Foreign Application Priority Data

Dec. 28, 2015 (KR) ..... 10-2015-0187746

(51) Int. Cl.

| | |
|---|---|
| ***H01H 71/50*** | (2006.01) |
| ***H01H 71/52*** | (2006.01) |
| ***H01H 71/62*** | (2006.01) |
| *H01H 71/04* | (2006.01) |

(52) U.S. Cl.

CPC ..... *H01H 71/501* (2013.01); *H01H 71/52* (2013.01); *H01H 71/62* (2013.01); *H01H 2071/046* (2013.01)

(58) Field of Classification Search

CPC ..... H01H 71/501; H01H 71/52; H01H 71/62
See application file for complete search history.

(56) References Cited

U.S. PATENT DOCUMENTS

| | | | | |
|---|---|---|---|---|
| 3,605,052 | A | 9/1971 | Dimond et al. | |
| 5,165,532 | A | 11/1992 | Pipich et al. | |
| 5,296,664 | A | 3/1994 | Crookston et al. | |
| 5,302,925 | A * | 4/1994 | Castonguay | H01H 71/501 200/43.14 |
| 8,264,306 | B2 * | 9/2012 | Baek | H01H 1/226 335/15 |
| 8,901,446 | B2 * | 12/2014 | Fong | H01H 9/345 218/26 |
| 2004/0061580 | A1 * | 4/2004 | Miura | H01H 71/501 335/172 |

FOREIGN PATENT DOCUMENTS

| | | | | |
|---|---|---|---|---|
| CN | 1490838 | A | 4/2004 | |
| CN | 201417722 | Y | 3/2010 | |
| CN | 203118880 | | 8/2013 | |
| EP | 0008989 | | 3/1980 | |
| EP | 0008989 | A1 * | 3/1980 | H01H 71/0207 |
| EP | 2023365 | | 2/2009 | |

(Continued)

OTHER PUBLICATIONS

English translatioon of EP0008989A1 (Year: 1980).*

(Continued)

*Primary Examiner* — Bernard Rojas
(74) *Attorney, Agent, or Firm* — K&L Gates LLP

(57) ABSTRACT

The present invention relates to a multi-pole molded case circuit breaker, more particularly, to a multi-pole molded case circuit breaker having a safety device (with an isolation function) which prevents a manipulation handle from being moved to an off-position when a fusion occurs on a contact part.

3 Claims, 14 Drawing Sheets

(56) References Cited

FOREIGN PATENT DOCUMENTS

| | | |
|---|---|---|
| KR | 100697507 | 4/2004 |
| KR | 100697507 | 3/2007 |
| KR | 2020130000058 | 1/2013 |
| KR | 2020130004247 | 7/2013 |
| KR | 200477245 Y1 | 5/2015 |

OTHER PUBLICATIONS

European Patent Office Application Serial No. 161978085, Search Report dated Feb. 28, 2017, 6 pages.
Korean Intellectual Property Office Application No. 10-2015-0187746, Office Action dated Dec. 8, 2016, 6 pages.
Chinese Office Action for related Chinese Application No. 201611237148.2; action dated Apr. 23, 2018; (7 pages).
Korean Intellectual Property Office Application No. 10-2015-0187746, Notice of Allowance dated Jun. 7, 2017, 7 pages.

* cited by examiner

MULTI-POLE MOLDED CASE CIRCUIT BREAKER WITH A SAFETY DEVICE

CROSS-REFERENCE TO RELATED APPLICATION

Pursuant to 35 U.S.C. § 119(a), this application claims the benefit of earlier filing date and right of priority to Korean Application No. 10-2015-0187746, filed on Dec. 28, 2015, the contents of which are all hereby incorporated by reference herein in its entirety.

BACKGROUND OF THE INVENTION

1. Field of the Invention

The present invention relates to a multi-pole molded case circuit breaker, more particularly, to a multi-pole molded case circuit breaker having a safety device (with an isolation function) which prevents a manipulation handle from being moved to an off-position when a fusion occurs on a contact part.

2. Description of the Conventional Art

In general, an MCCB (Molded Case Circuit Breaker) is a device which protects a circuit or load by cutting-off a circuit when an abnormal current or an overload is generated. Further, a multi-pole molded case circuit breaker is a kind of a molded case circuit breaker having a plural-phase, such as a 3-phase circuit. For instance, when the 3-phase circuit includes a neutral polarity, the circuit breaker may be a 4-pole circuit breaker including a 4-pole (R, S, T and N poles).

FIG. 1 is a view illustrating a longitudinal section of a base module of a multi-pole molded case circuit breaker.

In FIG. 1, there is not shown a case, but an open/close device coupled to a base mold 15 and a part related to a contact part.

FIG. 2 is a perspective view illustrating the base module of FIG. 1. In FIG. 2, the base mold 15 is not shown and parts are shown separately by each phase.

FIG. 3 is a disassembled view illustrating a partial open/close device including a handle of FIG. 2.

In a general multi-pole molded case circuit breaker, a shaft is manufactured in the form of module with a base mold by each phase, such as R, S, T and N in order to reduce production cost and increase manufacturing efficiency. That is, fixed contacts, movable contacts, a shaft assembly, an arc chamber, and the like are molded in the type of block within the base mold of each phase, and such a blocked parts are disposed within a separate outer case, then the multi-pole molded case circuit breaker is manufactured. By manufacturing each pole (phase) of the multi-pole molded case circuit breaker in a modularized part, it is possible to reduce production cost and increase assembly performance and productivity.

According to such a modularized multi-pole molded case circuit breaker, there is advantage in the sense of manufacturing, while involving disadvantage in that since durability (resistance) against a bending load is low, compared to a single-type molded shaft, a load may not be uniformly transferred to each phase in the mechanism.

First, the structure and operation of a module type multi-pole molded case circuit breaker will be described as follows.

An open/close device includes a toggle link (not shown) and a release device 9 which are coupled to a pair of side plates 11. The toggle link device includes an open/close lever 2 which is rotatably connected to a handle 1, and an upper link 3 and a lower link 4 which are connected via a link shaft 5, and disposed between a movable contact 6 and a latch 7.

A release device 9 is connected to the latch 7 and a latch holder 8 and is configured to release the latch 7 by interworking with an operation of an over-current release device (not shown). A main spring 10 is disposed between the open/close lever 2 and the link shaft 5 of the toggle link device.

The switching operation of the multi-pole molded case circuit breaker is carried out as follows.

When a handle 5 is rotated to an OFF-position from an ON-position, an upper link 3 and a lower link 4 of the toggle link device are bent in ">"-shape with an elastic force of the main spring 10 so that the movable contact 6 is separated from the fixed contact 14, thereby causing the circuit to be opened.

Further, when an over-current release device (not shown) is operated due to an overcurrent which flows through the circuit, the release device 9 is operated by the output of the over-current release device to release a latch 7 which is caught by the latch holder 8. As a result, the latch 7 is rotated in counterclockwise direction and the open/close device is tripped so that the movable contact 6 is opened to cut-off a current. And the handle 1 is moved to an intermediate position between the ON and OFF positions together with the open/close lever 2 to indicate a trip operation. Further, when the circuit breaker is reclosed after the trip operation, the handle 1 is moved to an ON-position after moving to an OFF-position to reset a release device 16, the movable contact 6 is closed.

In the multi-pole molded case circuit breaker, when a fixed contact 14*a* and a movable contact 6*a* are fused due to an overcurrent which flows in the main circuit in a conductive (ON) state, the movable contact 6 is not moved so that contacts of the main circuit are in contact with each other though an overcurrent release device (not shown) is normally operated, and in such a condition the handle 1 is stopped at an ON-position.

However, it is possible to move the main spring 10 to an OFF-position by applying a larger force to the handle 1 than as usual even in a state that the contacts of the main circuit are fused and integrated, so that the circuit breaker is stopped. In this instance, a user may misunderstand the circuit breaker to be opened so that he may execute an investigation or maintenance work, thereby causing a safety accident such as an electric shock.

To prevent such a safety accident, the circuit breaker may have a function (an isolation function) to prevent the handle from being rotated to an OFF position even in a case that contacts are fused in a conductive condition. Such an example may be referred to as Korean Patent No. 10-0697507 (equivalent to JP Patent No. 3972782 and U.S. Pat. No. 6,924,720).

However, the conventional modular type multi-pole molded case circuit breaker does not provide an isolation function, considering a displacement phenomenon by an inclination (bending) between each phase. In such a conventional modular type multi-pole molded case circuit breaker, there is provided a shaft pin which connects each shaft in order to convey a rotational force of an open/close device to each phase.

Referring to FIG. 4, in the modular type multi-pole molded case circuit breaker, since the shaft 12 of each phase is divided, the shaft pin 13 is inclined so that an inclination may be generated. Thus, shaft 12 may rotate more than a design value, so that the main spring 10 exceeds a dead point and the handle 1 passes away an OFF-position, thereby occurring faulty. For instance, when the R-phase is fused, a height of the shaft pin 13 of the T-phase may differ by a predetermined gap. As a result, there is a disadvantage in that the shaft 12 may be rotated at a predetermined gap so that it may be misunderstood that it is a normal state even in a fused state.

SUMMARY OF THE INVENTION

An object of the present invention is to provide a multi-pole molded case circuit breaker, which provides an isolation function preventing a manipulation handle from being moved to an OFF-position even in a state that contacts of a main circuit are fused by an abnormal current and can compensate for a tilting phenomenon of a shaft pin.

To achieve these and other advantages and in accordance with the purpose of this specification, as embodied and broadly described herein, there is provided a multi-pole molded case circuit breaker, including a fixed contact, a movable contact configured to be in contact with and separated from the fixed contact and shafts to which the movable contact is fixed, an open/close device configured to operate one of the shafts, and a shaft pin configured to connect the shafts, the multi-pole molded case circuit breaker including: a lower link having an indicator at one surface thereof; and a locking plate, rotatably mounted to a side plate, configured to allow or release movement of the handle to an OFF-position by contacting with the indicator, wherein the locking plate includes: a rotation prevention part formed in a predetermined length in line with inclination of the shaft pin and configured to restrict movement of the handle to an OFF-position by contacting with the indicator; and a rotation permission part, formed at one side of the rotation prevention part, configured to permit the handle to move to an OFF-position by being released from contact with the indicator.

In one embodiment, the rotation prevention part is formed in a slit.

In one embodiment, the rotation permission part is formed in a hole.

In one embodiment, the locking plate includes a lever restriction part configured to restrict an open/close lever coupled to the handle.

In one embodiment, the open/close lever includes a blocking protrusion, and the lever restriction part includes a restriction protrusion configured to be caught by the blocking protrusion.

In one embodiment, the length of the rotation prevention part is larger than a displacement of inclination of the shaft pin.

The multi-pole molded case circuit breaker according to one embodiment of the present invention provides an advantage in that a manipulation handle is prevented from being moved to an OFF-position when contacts of a main circuit are fused by an abnormal current.

Further, the multi-pole molded case circuit breaker according to one embodiment of the present invention provides an advantage in that an isolation function is not released within a predetermined range of gap, by compensating for a tilting of a shaft pin.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENT

Figure 1:
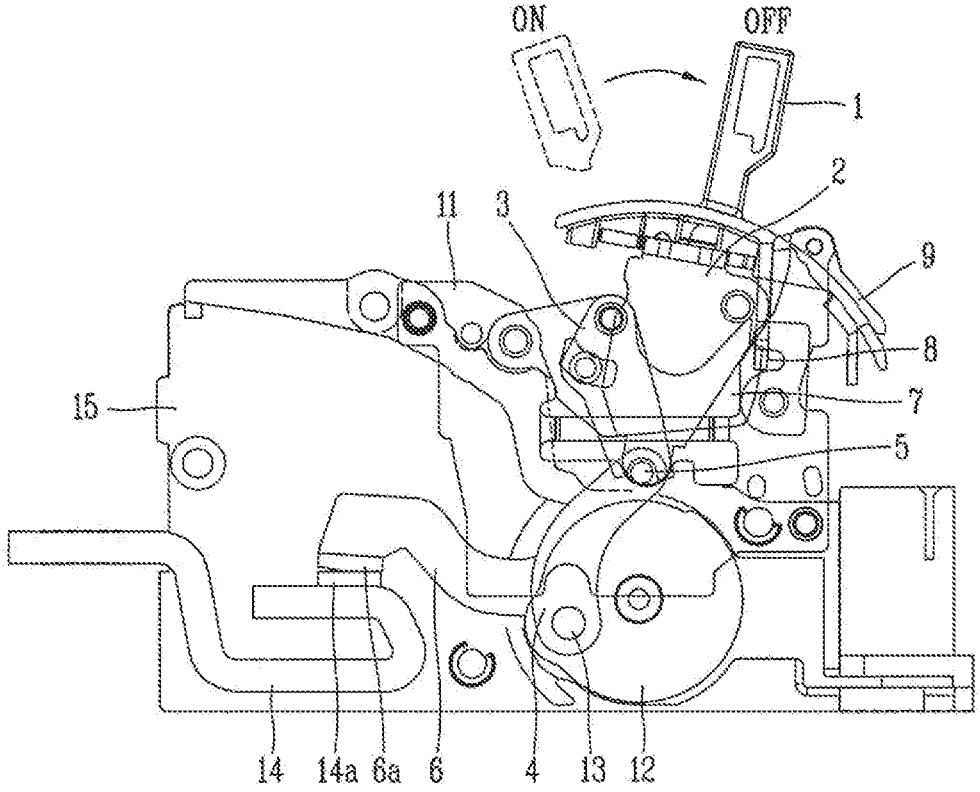
Fig. 1 Prior Art
FIG. 1 is a longitudinal sectional view illustrating a base mold of a multi-pole molded case circuit breaker, according to a conventional art.
Figure 2:
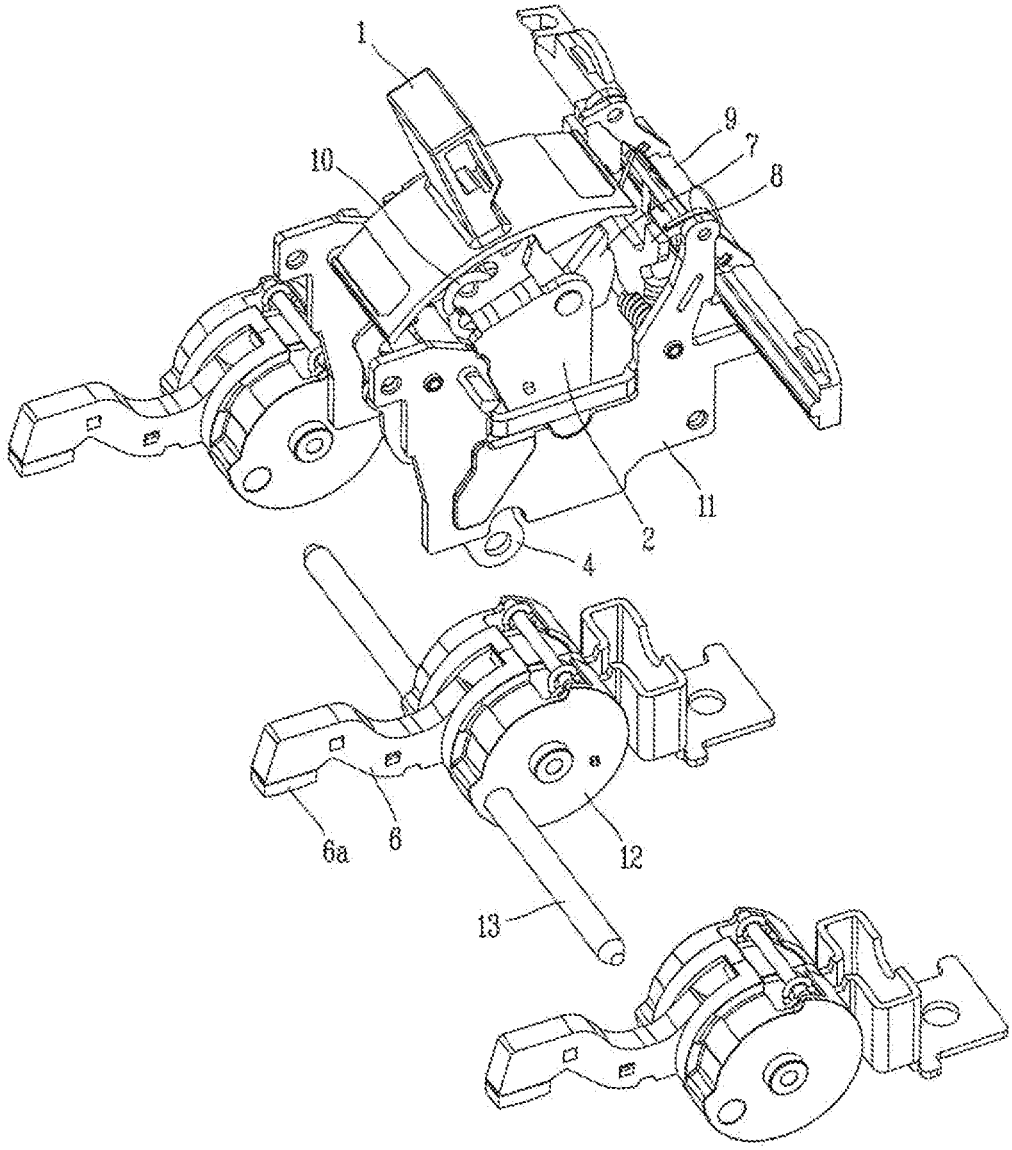
Fig. 2 Prior Art
FIG. 2 is a perspective view of FIG. 1, with the base mold excluded.
Figure 3:
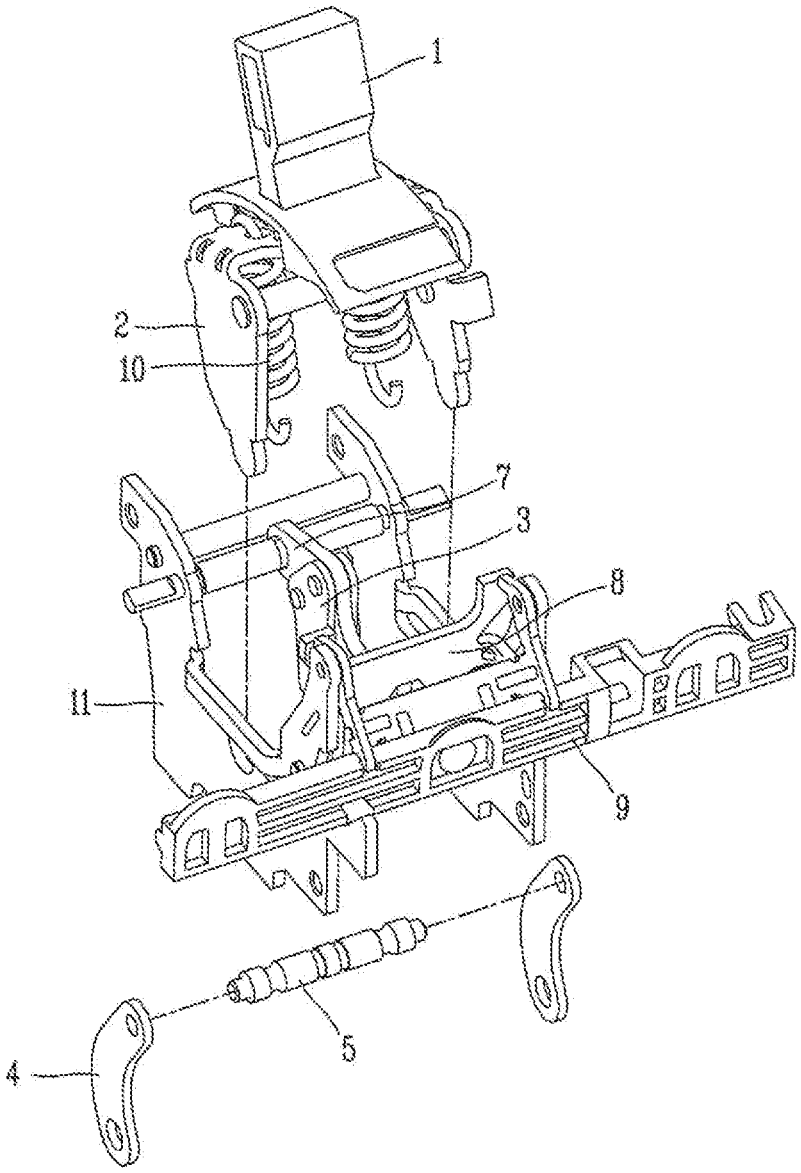
Fig. 3 Prior Art
FIG. 3 is a disassembled perspective view illustrating parts including a handle of FIG. 2.
Figure 4:
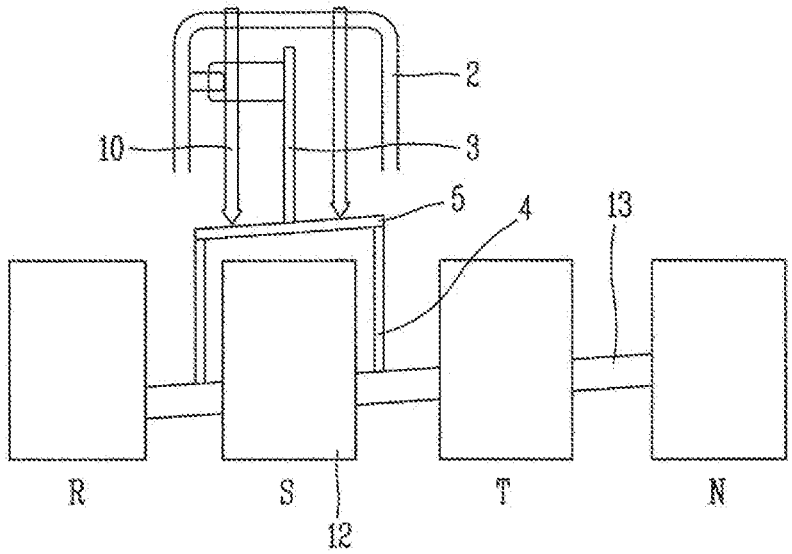
Fig. 4 Prior Art
FIG. 4 is a conceptual view illustrating a bending phenomenon of a shaft pin of a multi-pole molded case circuit breaker, according to a conventional art.
Figure 5:
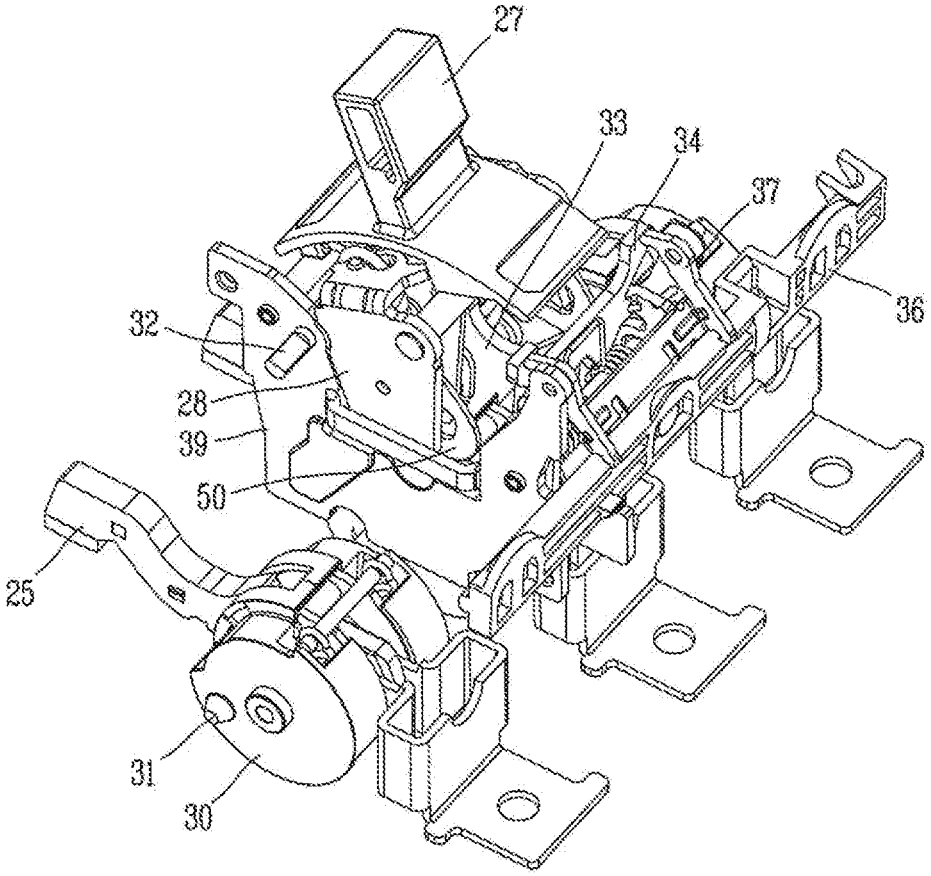
FIG. 5 is a partial perspective view illustrating a multi-pole molded case circuit breaker, according to one embodiment of the present invention.
Figure 6:
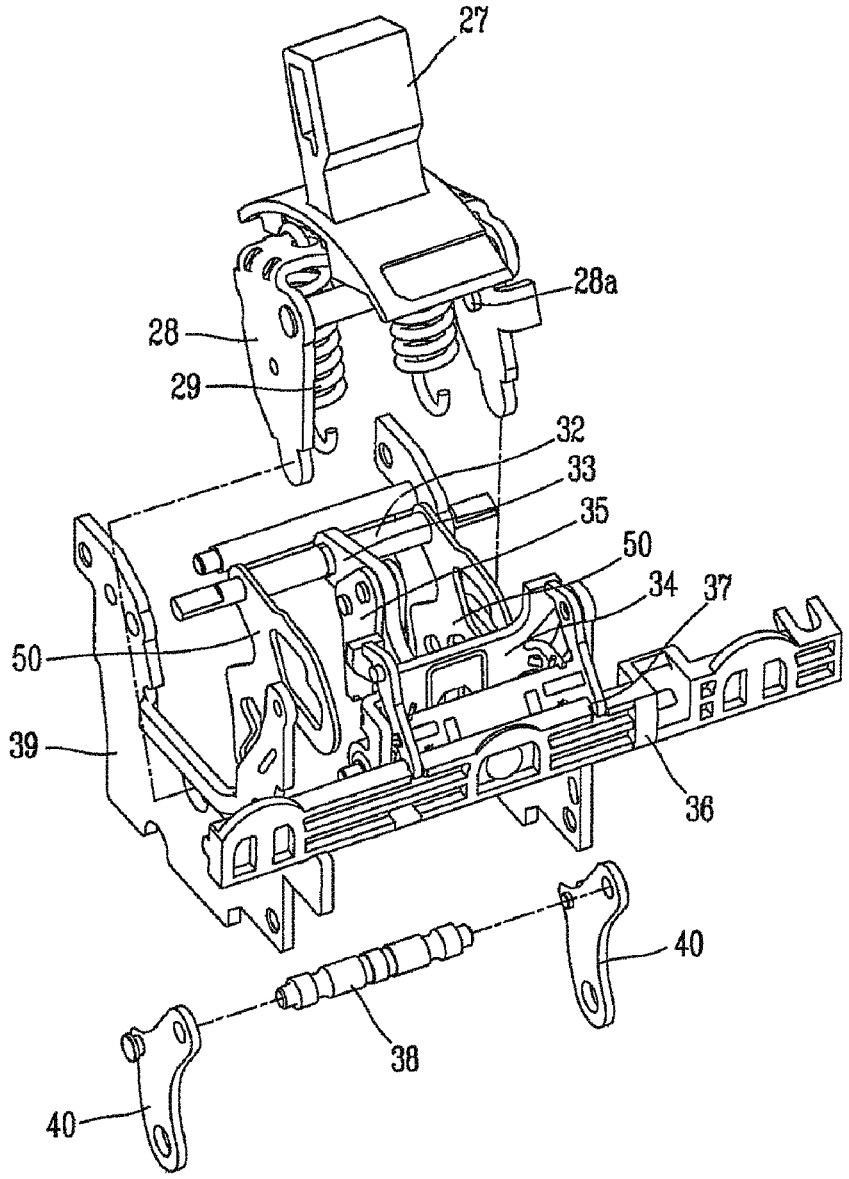
FIG. 6 is a disassembled perspective view illustrating an open/close device of a multi-pole molded case circuit breaker, according to one embodiment of the present invention.
Figure 7:
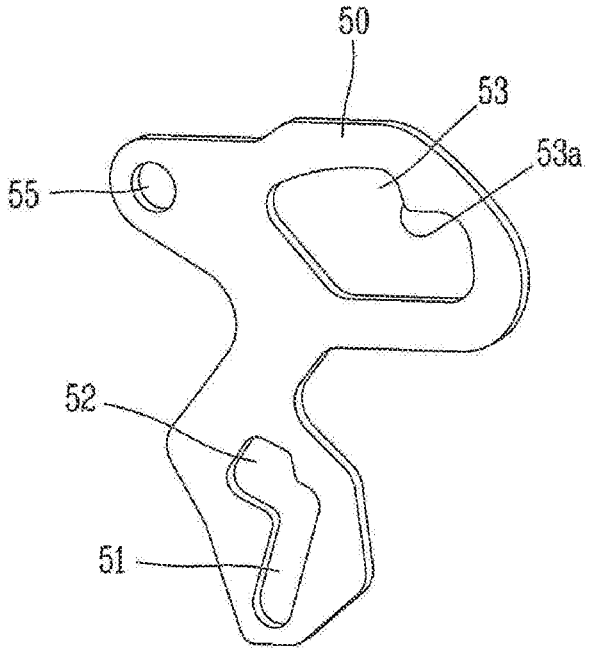
FIG. 7 is a perspective view illustrating a locking plate applied to a multi-pole molded case circuit breaker, according to one embodiment of the present invention.
Figure 8:
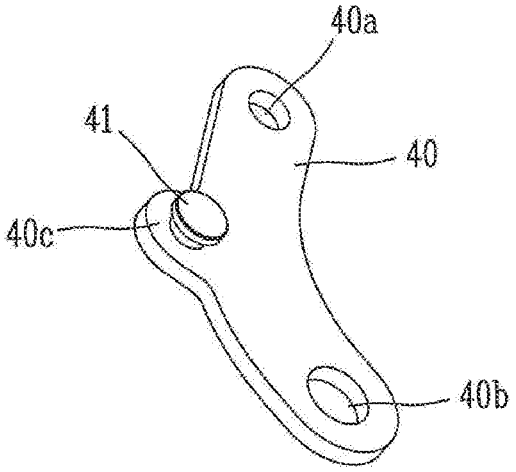
FIG. 8 is a perspective view illustrating a lower link applied to a multi-pole molded case circuit breaker, according to one embodiment of the present invention.
Figure 9:
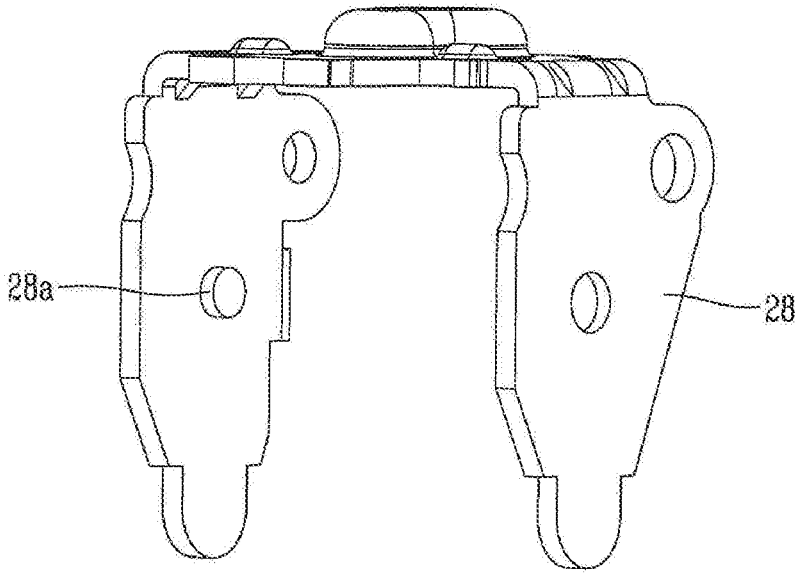
FIG. 9 is a perspective view illustrating an open/close lever applied to a multi-pole molded case circuit breaker, according to one embodiment of the present invention.

Hereinafter, a preferred embodiment of a door interlock device for a power transformer room in accordance with an embodiment of the present invention will now be described in detail with reference to the accompanying drawings.

Referring to FIGS. 5 through 9, the multi-pole molded case circuit breaker, according to one embodiment of the present invention includes a fixed contact 20, a movable contact 25 configured to be in contact with and separated from the fixed contact 20 and a shaft 30 to which the movable contact 25 is fixed, an open/close device configured to operate the shaft 30, and a shaft pin 31 configured to connect the shafts 30, a lower link 40 having an indicator 41 at one surface thereof; and a locking plate 50, rotatably mounted to a side plate 45, configured to allow or release movement of the handle 27 to an OFF-position by contact with the indicator 41, wherein the locking plate 50 includes a rotation prevention part 51 formed in a predetermined length in line with inclination of the shaft pin 31 and configured to restrict movement of the handle 27 to an OFF-position by contacting with the indicator 41; and a rotation permission part 52, formed at one side of the rotation prevention part 51, configured to permit the handle 27 to move to an OFF-position by being released from contact with the indicator 41.

According to a multi-pole molded case circuit breaker according to one embodiment of the present invention, includes a fixed contact 20 and a movable contact 25 configured to open or close a circuit by being in contact with or separated from the fixed contact 20 by each phase. The movable contact 25 is provided to a shaft 30 which is provided in each phase and configured to move according to rotation of the shaft 30. And a shaft pin 31 penetrating through the shaft 30 is provided to convey a rotational force of an open/close device to each shaft 30.

The open/close device includes a toggle link device and a release device which are mounted on a pair of side plates 39. The toggle link device includes a handle 27 and an open/close lever 28 connected to the handle 27 and configured to rotate to ON-OFF positions, and an upper link 35 and a lower link 40 which are connected via a link shaft 38. The upper link 35 is rotatably mounted by a latch 33 and the lower link 40 is rotatably mounted by a shaft pin 31. Here, the open/close lever 28 includes a blocking protrusion 28*a* at its inner surface.

The lower link 40 includes a shaft hole 40*a* through which a link shaft 38 is inserted and a pin hole 40*b* through which the shaft pin 31 is inserted, at its upper and lower ends, respectively. At the center of the lower link 40, an extended surface 40*c*, on which an indicator 41 is provided, is formed.

The release device includes a latch 33 of the lever type, a latch holder 34 configured to restrict the latch 33, a cross bar 36 and a nail 37 which are configured to move by interworking with an overcurrent release device (not shown), and the latch 33 is released when the cross bar 36, the nail 37 and the latch holder 34 are moved by the overcurrent release device.

Further, between the open/close lever 28 and the link shaft 38 of the toggle link device, a main spring 29 is disposed to maintain the force in the ON-OFF states.

A locking plate 50 is rotatably mounted to a latch shaft 32. The locking plate 50 may be formed in a flat plate and includes a latch shaft hole 55 through which the latch shaft 32 is inserted at one side thereof and a rotation prevention part 51 and a rotation permission part 52 at another side thereof. Further, the locking plate 50 includes a lever restriction part 53 at its one side.

The rotation prevention part 51 may be formed in a slit (a sliding hole) of a predetermined length. The indicator 41 of the lower link 40 may be slidably inserted into the rotation prevention part 51. Here, the length of the rotation prevention part 51 may be preferably set to be larger than an inclination displacement, considering an inclination (bending) of the shaft pin 31. When the handle 27 is in an ON-state, the shaft 30 is rotated in an anticlockwise direction, and the indicator 41 is located at a lower part of the rotation prevention part 51. When the movable contact 25 is fused into the fixed contact 20 so that the shaft 30 is insufficiently rotated, the indicator 41 may not be escaped from the rotation prevention part 51 even though the handle 27 is arbitrarily rotated.

The rotation permission part 52 is a part to permit the shaft 30 to rotate. In a case where the movable contact 25 and the fixed contact 20 are not fused, the shaft 30 may be freely rotated so that the indicator 41 may be escaped from the rotation prevention part 51 and then moved into a region of the rotation permission part 52.

The rotation prevention part 51 and the rotation permission part 52 may be formed in single hole.

The lever restriction part 53 may be formed in a hole. The lever restriction part 53 may be a space where the blocking protrusion 28*a* of the open/close lever 28 is moved. The lever restriction part 53 includes a restriction protrusion 53*a* with which the blocking protrusion 28*a* contacts. When the indicator 41 is in contact with a connection spot of the rotation prevention part 51 and the rotation permission part 52, the blocking protrusion 28*a* is caught by the rotation restriction protrusion 53*a*, thereby limiting rotation of the open/close lever 28. In this instance, the handle 27 can not move to an OFF-position. When the indicator 41 approaches to the rotation permission part 52 after passing through the rotation prevention part 51, the blocking protrusion 28*a* is released from the restriction protrusion 53*a*, thereby permitting the open/close lever 28 to rotate. In this instance, the handle 27 may move to an OFF-position.

FIGS. 10 through 15 are views illustrating an ON-state, an OFF-state, a blocking state, a blocking released state, a trip state, and a contact fusing state of a multi-pole molded case circuit breaker, according to one embodiment of the present invention.

Hereinbelow, an open/close operation of the multi-pole molded case circuit breaker, according to one embodiment of the present invention will now be described.

Figure 10:
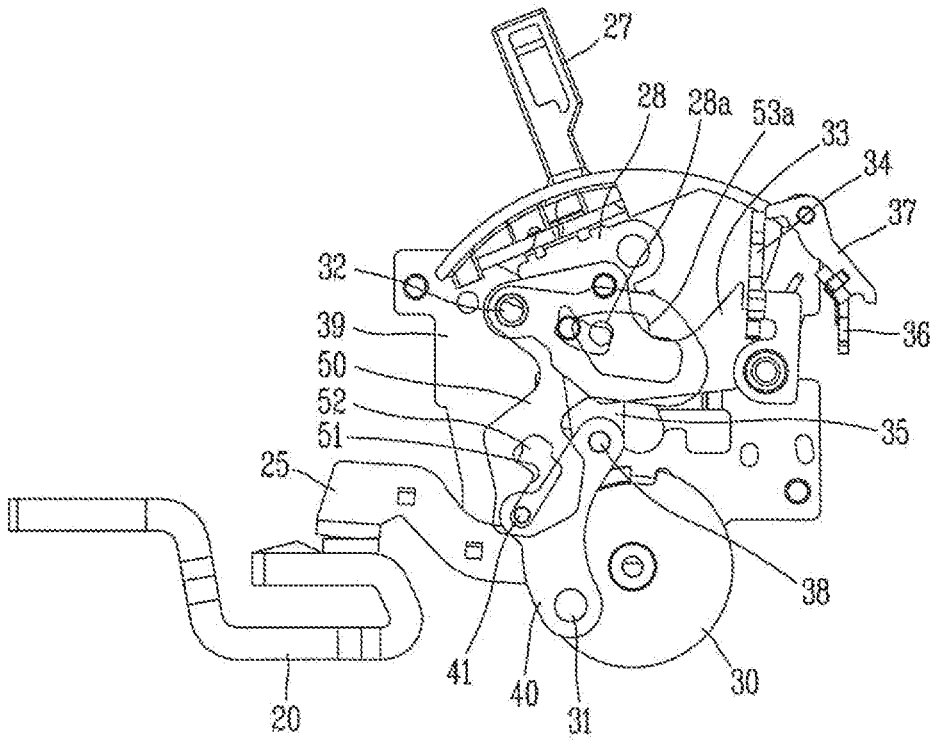
FIGS. 10 through 15 are views illustrating an ON-state, an OFF-state, a blocking state, a blocking released state, a trip state, and a contact fusing state of a multi-pole molded case circuit breaker, according to one embodiment of the present invention.
Figure 11:
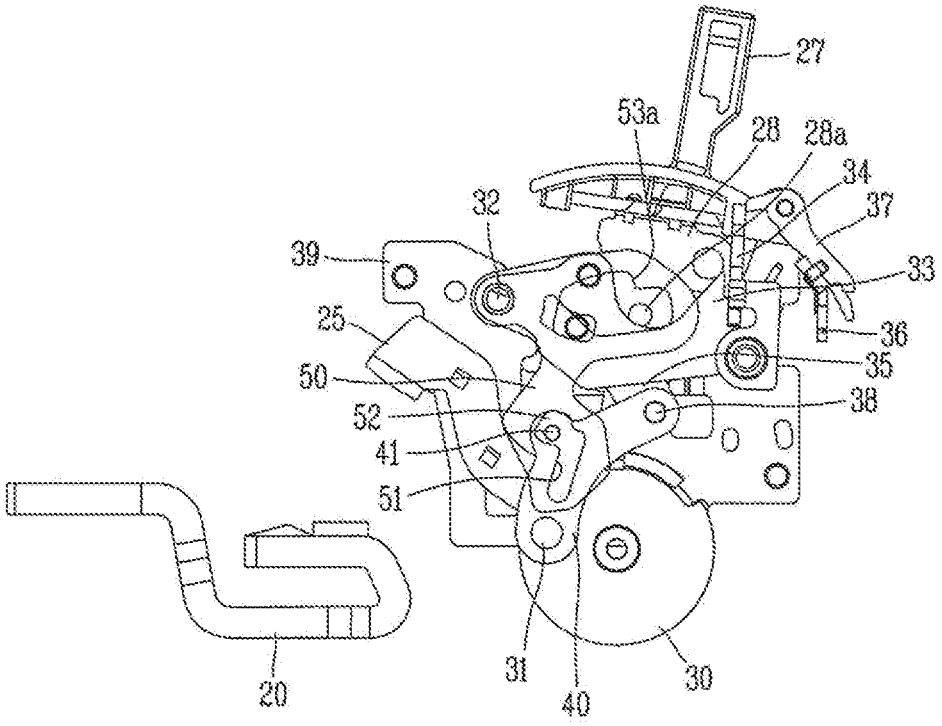

When the handle 27 is manipulated to move to an OFF-state in a closing state (ON), as shown in FIG. 10, the upper link 35 and lower link 40 of the toggle link device rotate the shaft 30, while being bent in a ">" shape by an elastic force of the main spring 28, so that the movable contact 25 is separated from the fixed contact 20, thereby opening the circuit, as can be seen in FIG. 11.

Figure 12:
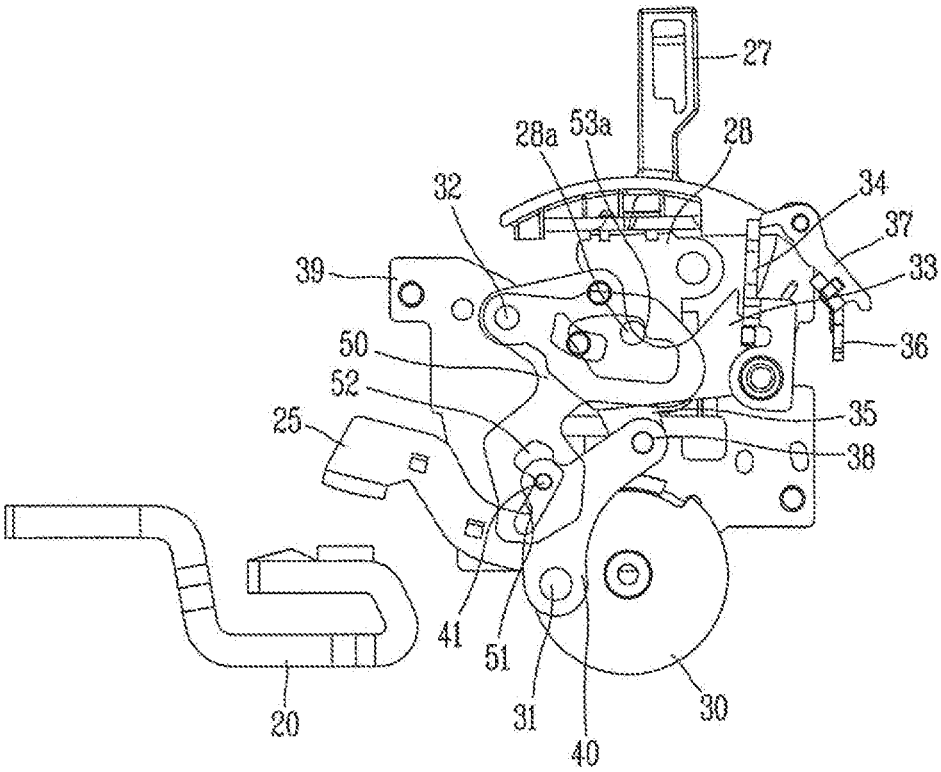
Figure 13:
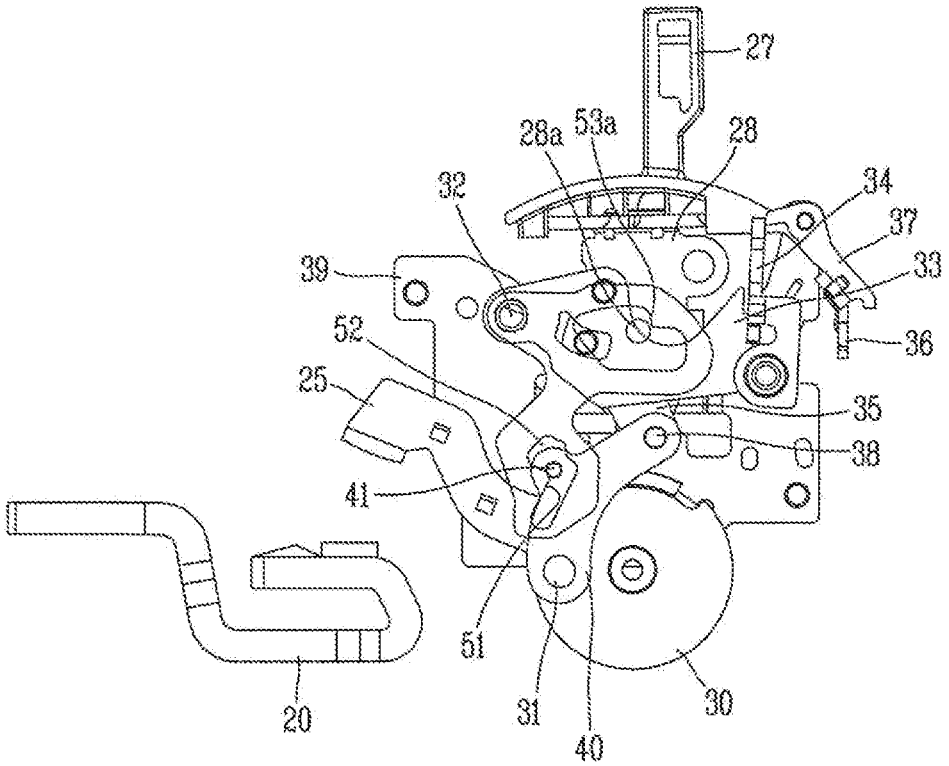

Referring to FIGS. 12 and 13, an intermediate state between an ON-state and an OFF-state will be described.

While the handle 27 is rotated at a certain range, the indicator 41 passes through the rotation prevention part 51, and in this state when a force applied to the handle 27 is removed, the handle 27 returns to an ON-position without moving to an OFF-state, and thus the movable contact 25 returns to an original position to contact with the fixed contact 20. When the handle 27 is sufficiently rotated, the indicator 41 enters into the rotation permission part 52 after passing through the rotation prevention part 51. In this instance, the blocking protrusion 28*a* is released from the restriction protrusion 53*a* so that the handle 27 may move to an OFF-position.

Figure 14:
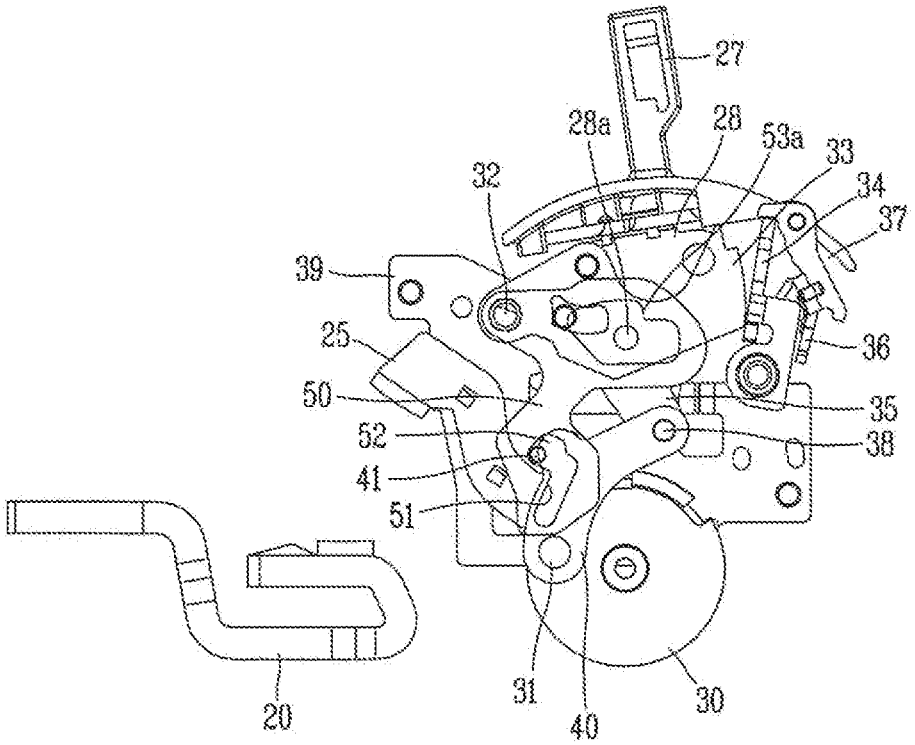

Referring to FIG. 14, when an overcurrent flows in a conductive state and as a result, an overcurrent release device (not shown) is operated, the cross bar 36 and nail 37 are operated by the output thereof to release the latch 33 which is caught by the latch holder 34. As a result, the latch 33 is rotated in an anticlockwise direction and an open/close device is tripped to open the movable contact 25, thus cutting off a current flow. Further, the handle 27 is moved by the trip operation to an intermediate position between an ON-position and an OFF-position together with the open/close lever 28 to indicate the trip operation. Further, when the circuit breaker is reclosed after the trip operation, the release devices 33, 34, 36 and 37 are reset by moving the handle 27 to an OFF-position and then moving to an ON-position, the movable contact 25 is closed.

Figure 15:
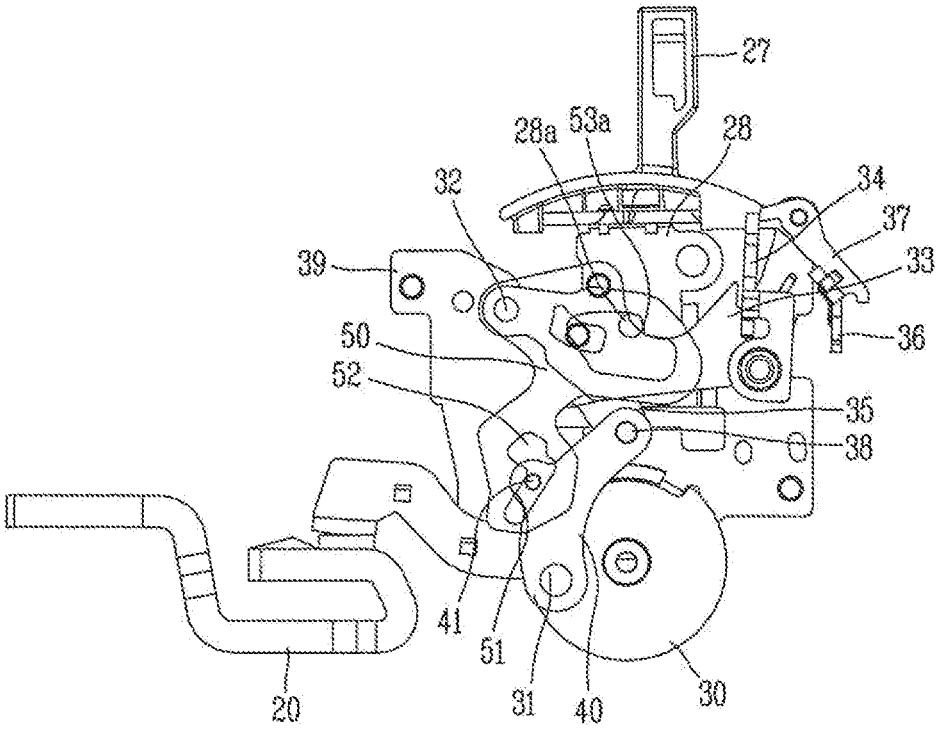

Referring to FIG. 15, when the fixed contact 20 and the movable contact 25 are fused due to an abnormal current flowing through a main circuit in a state that the contacts of a main circuit are closed, the movable contact 25 is not opened or closed even though an overcurrent release device (not shown) is normally operated, and contacts of the main circuit are maintained in a contact state. In this instance, since the indicator 41 is not escaped from the rotation prevention part 51 even though a user moves the handle 27 to an OFF-position, the blocking protrusion 28*a* is caught by the restriction protrusion 53*a* so that the handle 27 is not rotated any more to an OFF-position. In this instance, though a displacement of the shaft pin 31 occurs due to an inclination of each phase, movement of the handle 27 is restricted unless the handle 27 is rotated more than a range set by the rotation prevention part 51. That is, since length of the rotation prevention part 51 is formed larger than a displacement of the shaft pin 31 which is set by an inclination between each phase, an operation of the indicator 41 due to fusion of contacts is not included in a rotation permission range of the handle 27. That is, there is an advantage in that an isolation function is operated by compensating for displacement of the shaft 30 due to an inclination (bending) of the shaft pin 31.

In accordance with one embodiment of the present invention, there is provided an effect in that it is possible to restrict the manipulation handle to move to an OFF-position in a state that contacts of the main circuit are fused by an abnormal current.

Further, there is also an advantage in that an isolation function is not released within a predetermined range of gap by compensating for inclination of a shaft pin.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A multi-pole molded case circuit breaker, including a fixed contact, a movable contact configured to be in contact with and separated from the fixed contact and shafts to which the movable contact is fixed, an open/close device configured to operate one of the shafts, and a shaft pin configured to connect the shafts, the multi-pole molded case circuit breaker comprising:

a lower link having an indicator at one surface thereof; and a locking plate, rotatably mounted to a side plate, configured to allow or release movement of the handle to an OFF-position by being in contact with the indicator, wherein the locking plate includes a lever restriction part configured to restrict an open/close lever coupled to the handle, and wherein the open/close lever includes a blocking protrusion, and the lever restriction part includes a restriction protrusion configured to be caught by the blocking protrusion, wherein the locking plate includes:

a rotation prevention part formed in a predetermined length in line with inclination of the shaft pin and configured to restrict movement of the handle to an OFF-position by being in contacting with the indicator; and a rotation permission part, formed at one side of the rotation prevention part, configured to permit the handle to move to an OFF-position by being released from contact with the indicator, and wherein the length of the rotation prevention part is larger than displacement of inclination of the shaft pin.

2. The multi-pole molded case circuit breaker of claim 1, wherein the rotation prevention part is formed in a slit.

3. The multi-pole molded case circuit breaker of claim 1, wherein the rotation permission part comprises a hole.

* * * * *